US005239935A

United States Patent [19]

Morrow et al.

[11] Patent Number: 5,239,935

[45] Date of Patent: Aug. 31, 1993

[54] OSCILLATING DAMPER AND AIR-SWEPT DISTRIBUTOR

[75] Inventors: Robert S. Morrow, Southgate; David C. Reschly, Monroe, both of Mich.

[73] Assignee: Detroit Stoker Company, Monroe, Mich.

[21] Appl. No.: 794,453

[22] Filed: Nov. 19, 1991

[51] Int. Cl.[5] ..... F23K 3/02

[52] U.S. Cl. ..... 110/104 R; 110/115; 110/106; 110/267; 110/269

[58] Field of Search ..... 110/104 R, 115, 292, 110/102, 106, 269, 267

[56] References Cited

U.S. PATENT DOCUMENTS

| | | | |
|---|---|---|---|
| 441,689 | 12/1890 | McAuley . | |
| 717,935 | 1/1903 | Shontz . | |
| 740,097 | 9/1903 | Davis . | |
| 745,247 | 11/1903 | Shontz . | |
| 755,662 | 3/1904 | Hill . | |
| 789,796 | 5/1905 | Cooke . | |
| 984,715 | 2/1911 | Swift . | |
| 1,132,715 | 3/1915 | Greenstreet . | |
| 1,173,995 | 2/1916 | Boardman . | |
| 1,211,591 | 1/1917 | Kenney et al. . | |
| 1,243,186 | 10/1917 | Kohout . | |
| 1,300,272 | 4/1919 | Jackson et al. . | |
| 1,437,342 | 11/1922 | Griggs et al. . | |
| 1,645,392 | 10/1927 | Nash . | |
| 1,671,331 | 5/1928 | Turner et al. . | |
| 1,738,379 | 12/1929 | Lower . | |
| 1,931,181 | 10/1933 | Culver . | |
| 2,065,552 | 12/1936 | Beers . | |
| 2,075,274 | 3/1937 | Darling . | |
| 2,099,618 | 11/1937 | Olney . | |
| 2,119,010 | 5/1938 | Hogg . | |
| 2,121,313 | 6/1938 | Binney . | |
| 2,177,794 | 10/1939 | Turner . | |
| 2,198,710 | 4/1940 | Turner . | |
| 2,357,899 | 9/1944 | Kohout . | |
| 2,418,042 | 3/1947 | Mosshart | 110/115 |
| 2,531,779 | 11/1950 | Midgette et al. . | |
| 2,581,037 | 1/1952 | Meissner et al. . | |
| 2,618,621 | 11/1952 | Burt . | |
| 2,702,726 | 2/1955 | Frendberg . | |
| 2,735,384 | 2/1956 | Kohout . | |
| 2,829,784 | 4/1958 | Henry et al. . | |
| 2,849,465 | 8/1958 | Randall et al. . | |
| 2,850,183 | 9/1958 | Blundin . | |
| 2,894,465 | 7/1959 | Phillips . | |
| 3,167,191 | 1/1965 | Zellers, Jr. . | |
| 3,482,534 | 12/1969 | Whitman . | |
| 3,610,182 | 10/1971 | Stockman | 110/115 |
| 3,699,502 | 10/1972 | Carter . | |
| 3,702,726 | 11/1972 | Takeichi et al. . | |
| 3,902,436 | 9/1975 | Turner et al. . | |
| 4,046,325 | 9/1977 | Tucsok et al. . | |
| 4,102,278 | 7/1978 | McManama . | |
| 4,268,174 | 5/1981 | Falardeau . | |
| 4,278,052 | 7/1981 | Sharp . | |
| 4,311,102 | 1/1982 | Kolze et al. . | |
| 4,326,469 | 4/1982 | Reschly . | |
| 4,434,724 | 3/1984 | Kunkel, Jr. . | |
| 4,445,628 | 5/1984 | Cain . | |
| 4,475,468 | 10/1984 | Ishikawa et al. . | |
| 4,528,917 | 7/1985 | Jacobs . | |
| 4,532,872 | 8/1985 | Anderson . | |
| 4,570,552 | 2/1986 | Rachner et al. . | |
| 4,602,572 | 7/1986 | Giaier et al. . | |
| 4,605,573 | 8/1986 | Deeg et al. . | |
| 4,648,329 | 3/1987 | Couarc'h et al. . | |
| 4,718,360 | 1/1988 | Giaier et al. . | |
| 4,905,613 | 3/1990 | Reschly et al. . | |
| 4,954,034 | 9/1990 | Nelson et al. . | |
| 5,030,054 | 7/1991 | Reschly et al. . | |

FOREIGN PATENT DOCUMENTS

| | | |
|---|---|---|
| 1091542 | 4/1955 | France . |

*Primary Examiner*—Henry C. Yuen
*Attorney, Agent, or Firm*—Harness, Dickey & Pierce

[57] ABSTRACT

An oscillating damper and air-swept distributor is disclosed for controllably introducing solid fuel into a furnace. The oscillating damper having an oscillating valve member, which oscillates between a first adjustable position and second adjustable position. The air-swept distributor preferably has a pivotably adjustable trajectory plate.

8 Claims, 9 Drawing Sheets

FIG. 7.
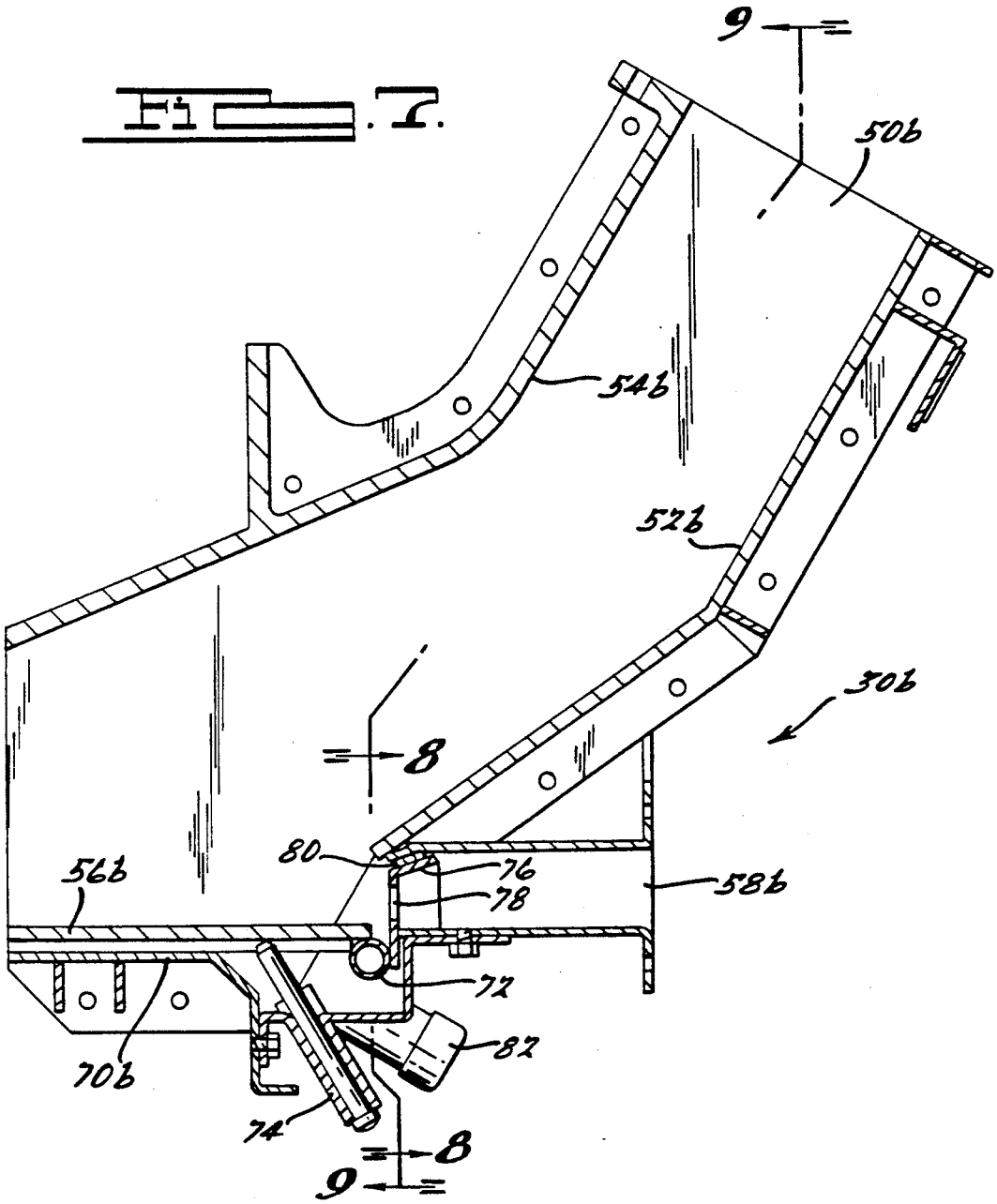
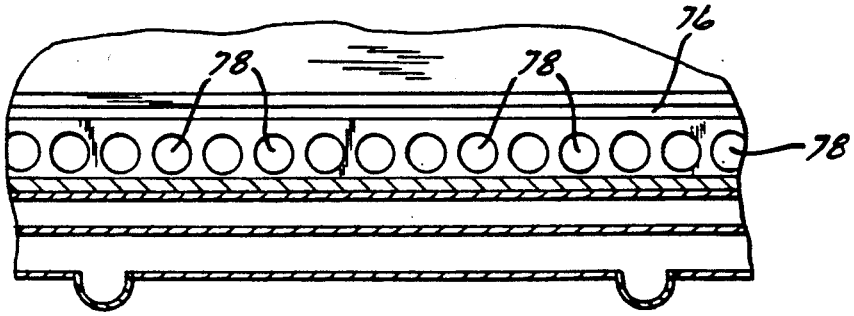
FIG. 8.

OSCILLATING DAMPER AND AIR-SWEPT DISTRIBUTOR

BACKGROUND AND SUMMARY OF THE INVENTION

The present invention relates to a device for introducing fuel into industrial furnaces (including boilers) fired by spreader stokers, fluidized bed combustion, and like technologies, and more particularly to an oscillating damper and an air-swept distributor.

Most fuel distributing devices in use today are of the mechanical or mechanical/pneumatic type. Such mechanical distributors use rotating shafts, blades or paddles to propel fuel into a furnace. Although mechanical distributors work adequately, they suffer the disadvantage of having many moving parts which are exposed to the heated furnace and thus present maintenance problems.

Pneumatic and mechanical/pneumatic systems, such as those having air-swept spout configurations, have been used for the incineration of refuse. Typically in these systems, a pneumatic distributor is attached to a metering device, which is remotely located and allows fuel consisting of coal, refuse, wood chips, or any mixture thereof to fall on an air-swept plate. The air sweeping over the plate pushes the fuel into the furnace. In the past, air supplies with a constant pressure have been used, tending to distribute the fuel at one area on the stoker and leading to inefficient combustion.

Attempts to more evenly distribute the fuel on the stoker have employed rotating valve dampers to vary the air pressure. The use of such rotating valve dampers has lead to fuel being distributed more evenly, but has resulted in a tendency of the fuel to collect toward the rear of the stoker, and thus has not effectively solved the problem of inefficient combustion. This is due largely to the inability to completely control the air flow and to the changing consistency of the fuel. Attempts to compensate for these factors by changing the elevation of the air-swept plate have frequently led merely to changes in the trajectory of the fuel but with no significant improvement in fuel distribution.

One of the primary objects of the present invention is to provide an even distribution of fuel over a stoker by providing a fully controllable air supply and air-swept distributor combination, thus optimizing the combustion process.

A fuel distribution system for distributing fuel into a furnace, in accordance with the invention includes at least one oscillating damper having a first body, a pivotal valve member mounted on the first body for oscillation about an axis, and a control mechanism attached to the valve member for controlling the oscillation of said valve member, thereby controllably adjusting the flow of air through said first body and to effect a throttling of the air flow. The system also includes at least one air-swept distributor having a second body, a trajectory plate pivotally attached to the second body for controlling the distribution of fuel into the furnace, a feature for directing air across the plate, with the directed air being operable to controllably blow the fuel across the plate and thereby further provide a controllable distribution of fuel into the furnace. In addition, the system includes an air conducting apparatus for communicating air from said oscillating damper to said air-swept distributor.

Other advantages and features will become apparent from the following description and claims, taken in connection with the accompanying drawings.

BRIEF DESCRIPTION OF THE DRAWINGS

FIG. 7 is a cross-sectional view of another embodiment an air-swept distributor in accordance with the present invention.

FIG. 8 is a partial cross-sectional view of an orifice plate, taken generally along line 8—8 of FIG. 7.

DETAILED DESCRIPTION OF THE PREFERRED EMBODIMENTS

Figure 1:
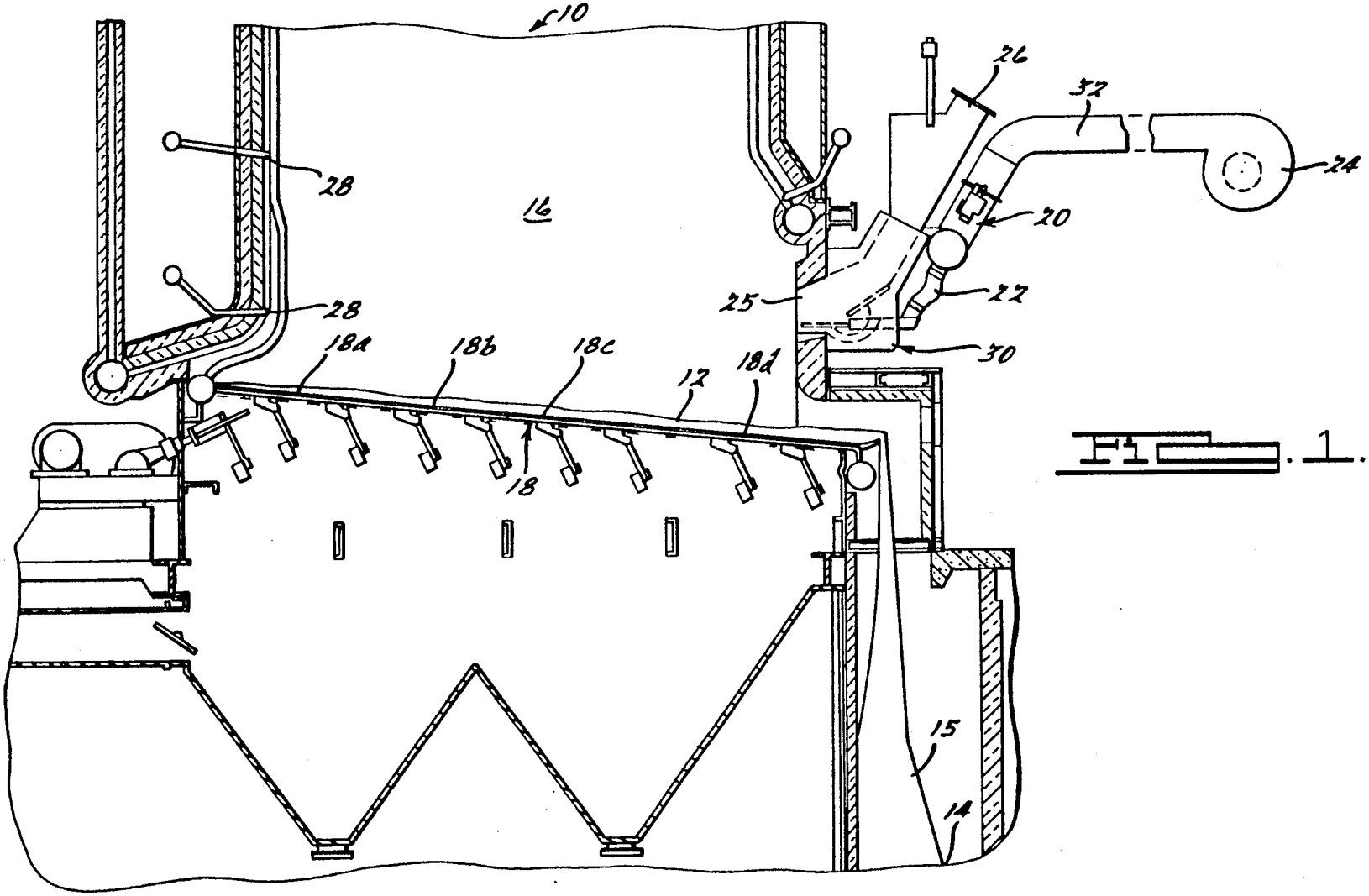
FIG. 1 is a diagrammatic cross-sectional view of a furnace having an exemplary oscillating damper and air-swept distributor according to the invention.
Figure 2:
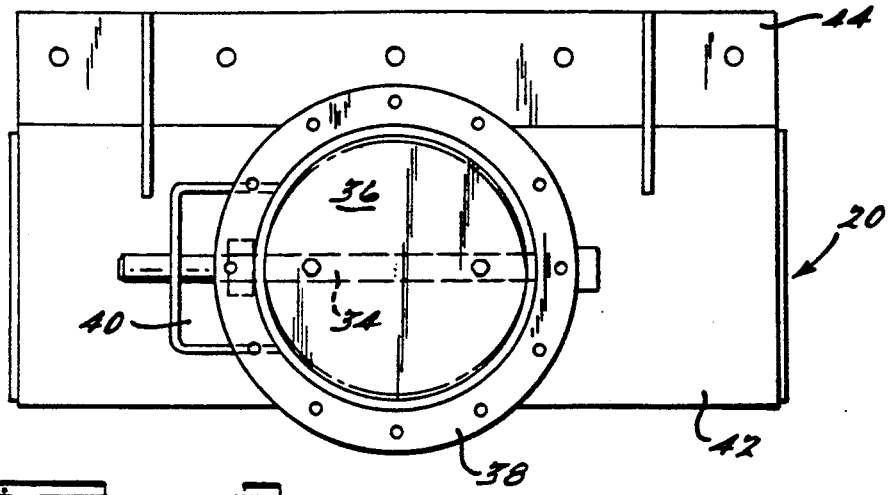
FIG. 2 is an end view of the oscillating damper portion of the distributor of FIG. 1.
Figure 3:
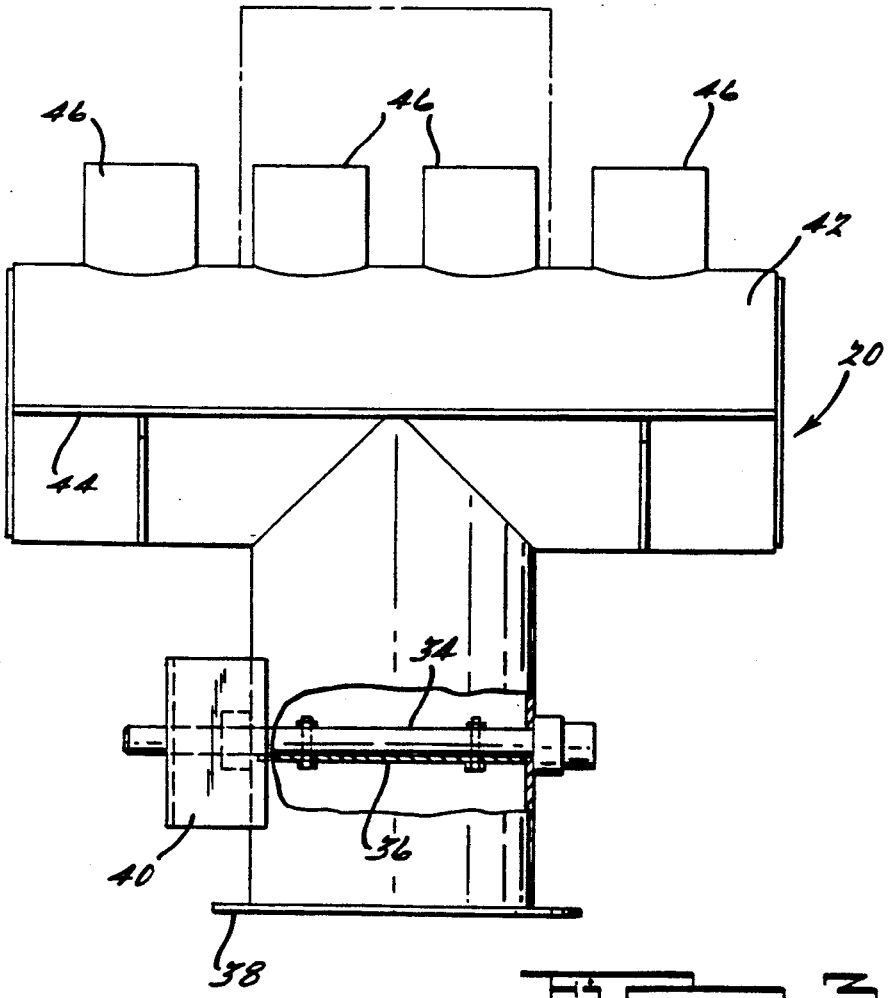
FIG. 3 is a top view of the oscillating damper portion of the distributor of FIG. 1.

Referring to FIGS. 1 through 3, a furnace 10 includes a vibrating grate stoker 18, a number of grate areas 18*a* through 18*d*, and an evenly distributed quantity of fuel 12. As the fuel 12 burns it produces heat in a combustion area 16 and ash 15, which is distributed in the ash storage hopper 14. An oscillating damper 20 controls the air flow from a fan 24 and communicates the air through an air duct 22 to an air-swept distributor 30. The air-swept distributor 30 is mounted on furnace 10 in operative cooperation with a fuel delivery recharging opening 25. Delivery of the fuel is aided by a balanced damper 26 which guards against over-pressure drafts of hot air and combustion gases entering into the fuel supply area.

The air-swept distributor 30 operates in conjunction with the oscillating damper 20 to distribute fuel over the grate areas 18*a* through 18*d*. Ideally, the fuel distribution should be as even as possible to ensure efficient combustion, which is aided by the use of a number of over-fire air nozzles 28.

The oscillating damper assembly 20 includes a large butterfly valve 36 attached to a valve shaft 34, as shown in FIGS. 2 and 3, and is attached to the air supply duct 32 by way of flange 38. A supporting flange 44 is optionally used to connect the assembly to the distributor 30 (FIG. 1) or any other suitable structure. The supporting flange 44 may be welded or otherwise suitably attached to an air plenum 42. The air plenum 42 provides the ability to split the air supply into multiple outlets 46 or optionally a larger outlet 48.

A drive and controller assembly 40 is rigidly attached to the oscillating damper 20 and provides adjustable control to the butterfly valve 36 through rotation of the valve shaft 34. One skilled in the art will readily recognize that the drive and control assembly 40 may include a controllable stepping motor, a reversible AC or DC motor, limiting switches for controlling the movement of the butterfly valve 36, or any of a number of other suitable drive and control mechanisms allowing complete control of the butterfly valve 36.

Figure 4:
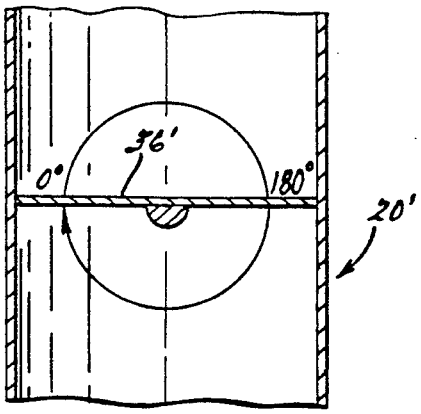
Prior Art FIG. 4.
FIG. 4 is a partial cross-sectional view of a rotating air damper, illustrating the motion of a valve member in accordance with typical prior art.
Figure 5:
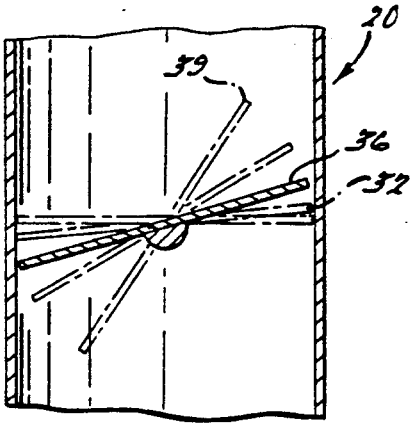
FIG. 5 is a partial cross-sectional view of an oscillating controller, illustrating the oscillating motion of the valve member in accordance with one embodiment of the present invention.

As shown in FIG. 4, a typical prior art rotating damper 20', having butterfly valve 36', makes complete continuous rotations. In sharp contrast, as is shown in FIG. 5, the butterfly valve 36 according to the invention can oscillate between first and second adjustable positions 32 and 39. The first adjustable position is a partially closed position ranging from 0° to 35° (0° being closed), and the second adjustable position is a partially open position ranging from 45° to 85° (90° being fully open). The oscillating movement of the butterfly valve 36 between the first adjustable position 32 and the second adjustable position 39 provides a more controllable air flow, especially since the movement of butterfly valve 36 may be controlled to have a time delay, or dwell time, at either the first or second adjustable positions 32 and 39.

Figure 6:
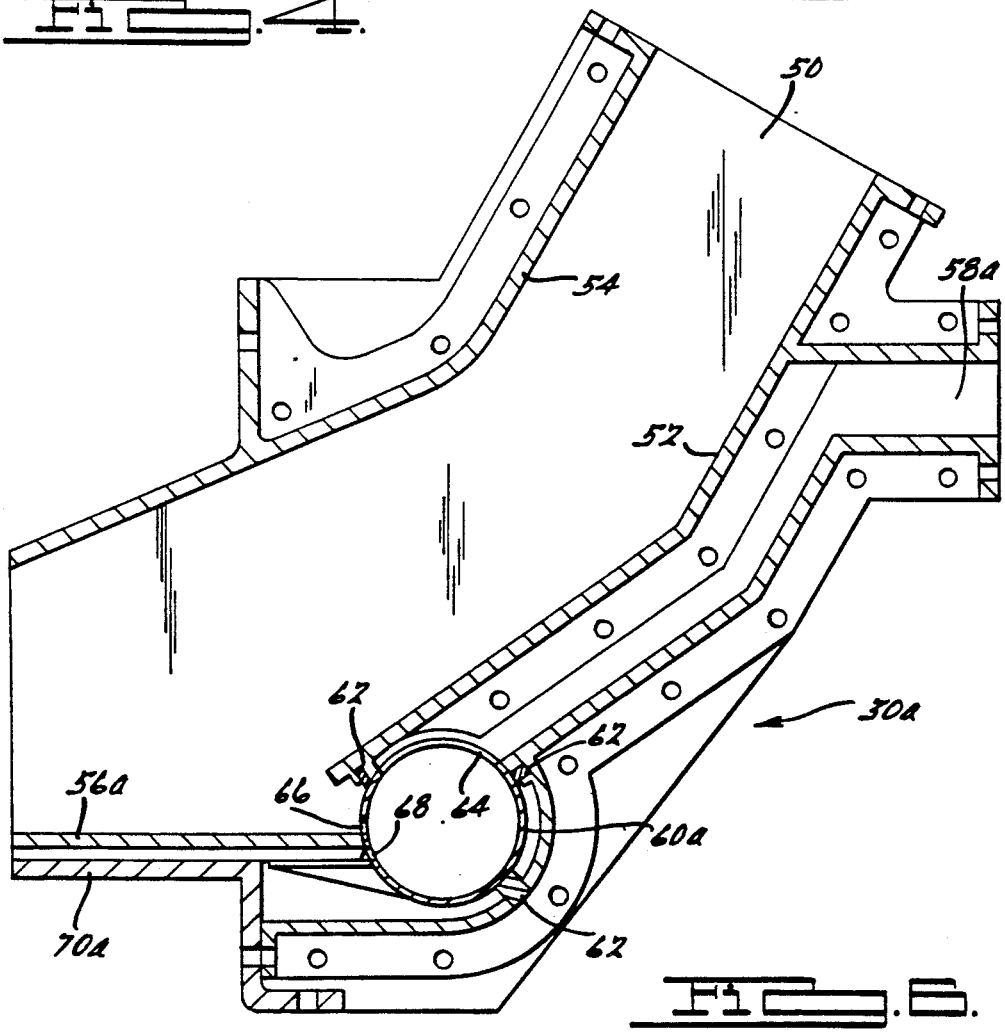
FIG. 6 is a cross-sectional view of one embodiment of an air-swept distributor in accordance with the present invention.

Turning now to the air-swept distributor 30*a*, as shown in FIG. 6, fuel enters the air-swept distributor 30*a* through a distributor throat 50 and slides under the force of gravity along a sliding surface 52 until it reaches a trajectory plate 56*a*. The trajectory plate 56*a* is positioned adjacent the bottom of the sliding surface 52, but spaced sufficiently therefrom to allow for adjustment of the trajectory plate 56*a* and for air passage thereby.

Due to the large volumes of fuel required, and the typically abrasive nature of the fuel, the sliding surface 52 and the trajectory plate 56*a* receive considerable abrasion and wear, thus necessitating the use of cladded wear plates having a hardened and wear resistant surface. The balance of the air-swept distributor 30*a*, including a distributor top 54 (shown in FIG. 9), a bottom plate 70*a*, an air duct 58*a*, and a rotating air plenum 60*a* may be formed from standard casting material.

Air duct 58*a* communicates air, or other gas or liquid propellant, to the rotatable air plenum 60*a* through a plenum opening 64. The rotatable air plenum 60*a* is engaged by high temperature seals 62, which form an air resistant barrier and help retain the air pressure therein. The high temperature seals 62 may be formed from high temperature fiber packing rope or a ceramic rope. The air from the air plenum 60*a* is evenly distributed along the trajectory plate 56*a* by way of an upper air sweep opening 66, with an additional lower sweep opening 68 being optional and functioning to clear fuel from below the trajectory plate 56*a*, thus providing unrestrained movement of the trajectory plate 56*a*. The rotatable air plenum 60 and trajectory plate 56*a* are connected to one another by any mechanically sound manner, such as by welding.

The overall operation of an air-swept distributor system according to the invention may be summarized as follows. A fuel such as wood chips or other refuse, enters the air-swept distributor 30*a* through the distributor throat 50, and slides down the sliding surface 52, propelled by gravity to encounter the trajectory plate 56*a*. Controlled air enters the air duct 58*a* and is directed onto and along the trajectory plate 56*a* by the rotatable air plenum 60*a*, with the air propelling the fuel along the trajectory plate 56*a* and into the furnace for combustion.

If satisfactory fuel distribution is not being obtained, the trajectory plate 56*a* may be tilted or reoriented by rotating the rotatable air plenum 60 slightly, and the air may be variably controlled by resetting the upstream oscillating damper 20 (see FIG. 1). The interconnected rotation of the rotating air plenum 60 and the trajectory plate 56*a* ensures that air will sweep at an adjustable rate along the surface of the trajectory plate 56*a*. Once the trajectory plate 56*a* is oriented such that substantially uniform coverage is obtained throughout the grate, from front to back and side to side, the combustion process consequently improves.

Figure 9:
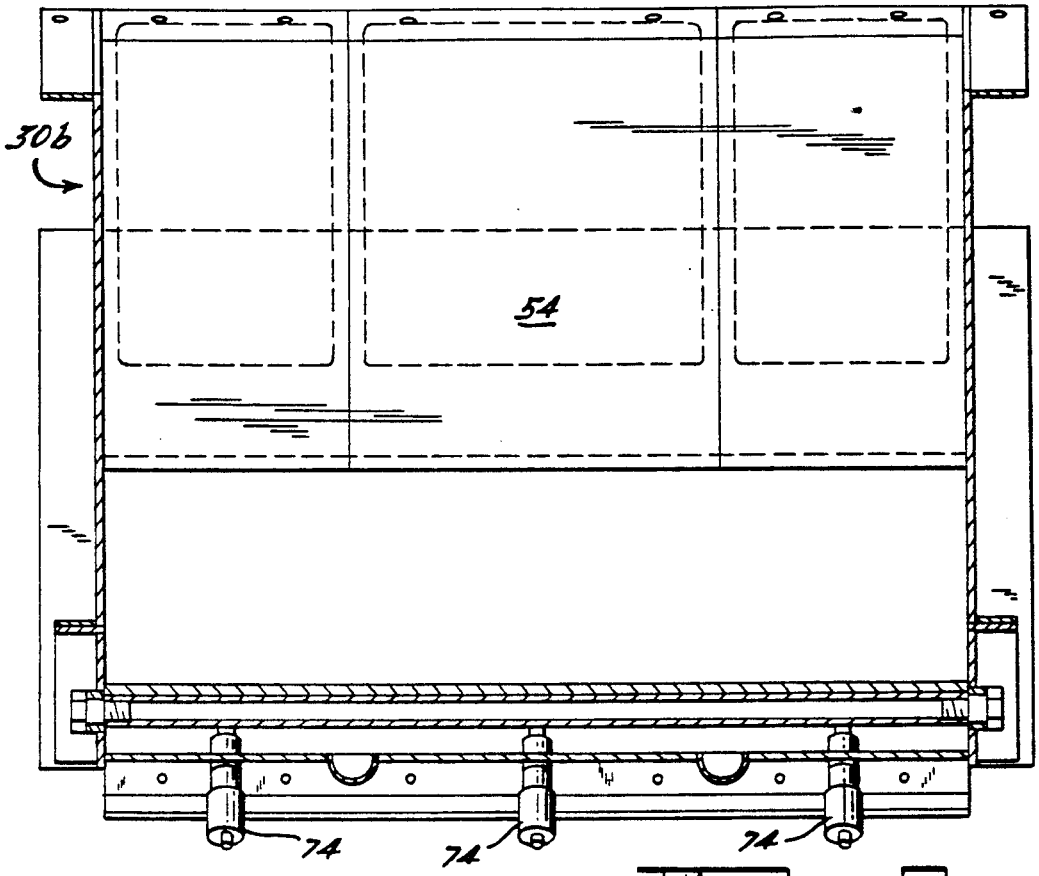
FIG. 9 is a cross-sectional view taken generally along line 9—9 in FIG. 7.

FIGS. 7 through 9 illustrate another air-swept distributor 30*b* in accordance with another embodiment of the present invention, with the distributor 30*b* having a rigid air duct 58*b* and a trajectory plate 56*b* supported by an elevating device 74. The air duct 58*b* in this embodiment is mechanically rigid and does not employ a rotating plenum. Instead an orifice plate 76 having multiple orifices 78, as shown in the frontal view of FIG. 8, is employed. The orifice plate 76 engages a seal 80 in order to prevent escape of pressurized air.

Air is directed from the air duct 58*b* and evenly distributed along the trajectory plate 56*b* by way of the multiple orifices 78. One skilled in the art will readily appreciate that the orifices 78 may have any number of alternate shapes, configurations and dimensions, so long as substantially even distribution of air occurs along the trajectory plate 56*b*.

The trajectory plate 56*b* is pivotably attached to the air-swept distributor 30*b* by a hinge 72. Elevation or reorientation of the trajectory plate 56*b* is adjustable by way of a number of elevating devices 74, which can be hydraulic jacks, screw jacks, or any of a number of other suitable mechanisms. The elevating devices 74 provide the advantage of a mechanically sound support for the trajectory plate 56*b* and are thus also useful to provide shock-proof support for the trajectory plate 56*b*. Therefore, this embodiment of the present invention may be best suited for distributing fuel in which heavy solids can impact the trajectory plate 56*b*.

Additionally in the distributor 30*b*, an optional access opening 82 can be provided for cleaning and removing obstructing material from between the trajectory plate 56*b* and the bottom plate 70*b*, thus preventing such obstacles from impeding full operational movement of the trajectory plate 56*b*.

Figure 10:
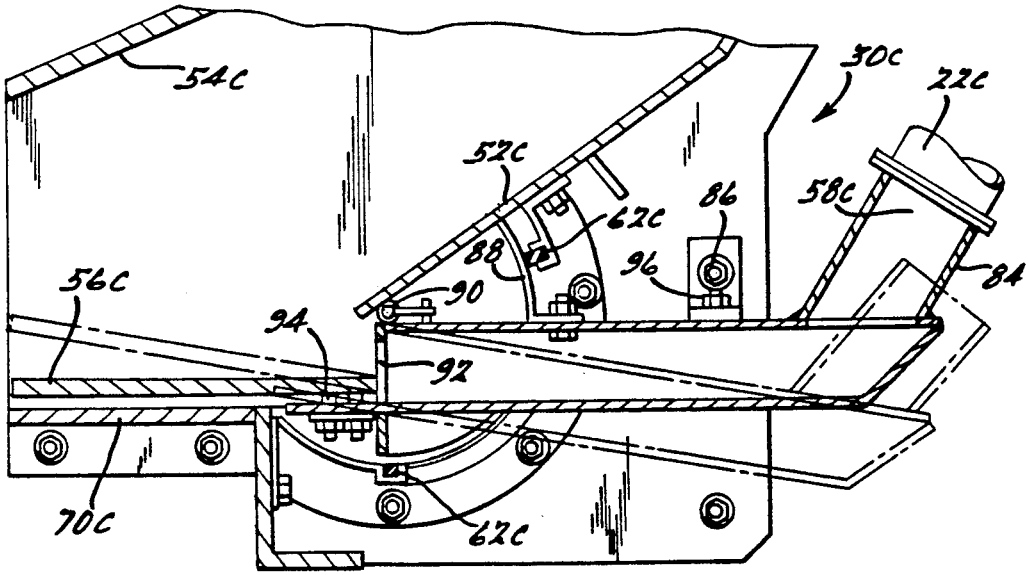
FIG. 10 is a partial cross-sectional view of another embodiment of an air-swept distributor having a unified plenum and distributor plate in accordance with one embodiment of the present invention.

Another air-swept distributor 30*c*, in accordance with another embodiment of the present invention, includes a unified trajectory plate 56*c* and air duct 58*c*, and is shown in FIG. 10. The air duct 58*c* in FIG. 10 is attached to the trajectory plate 56*c* by way of one or more threaded fasteners 94, which function to fasten and elevate the trajectory plate 56*c* by way of rotation of the fasteners 94.

Air enters the air duct 56*c* by way of a flexible hose 22*c* attached to the air duct hose connector 84 and is directed over and under the air-swept plate 56*c* by way of an orifice or opening 92. The unified air duct 58*c* and trajectory plate 56*c* are pivotably interconnected by way of a hinge 90, a rotating housing 88, an adjustable retainer 86, and a threaded adjusting screw or nut 96. Pneumatic integrity is maintained by use of seals 62*c*, which are designed to withstand high temperatures and allow rotation of the rotatable housing 88.

Figure 11:
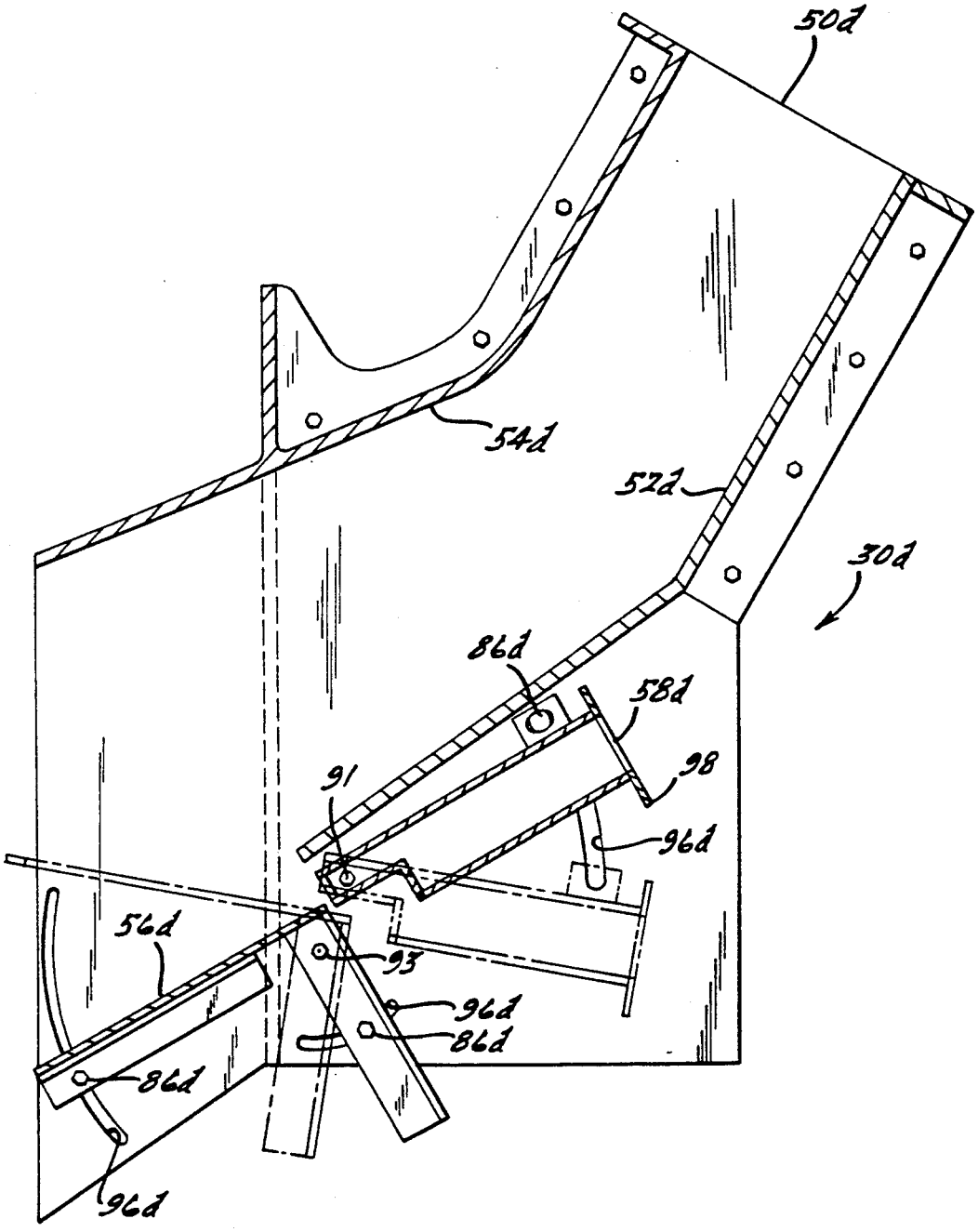
FIG. 11 is a cross-sectional view of still another embodiment of an air-swept distributor having independently adjustable air duct and trajectory plate in accordance with the present invention.

Yet another air-swept distributor 30*d* in accordance with one embodiment of the present invention is shown in FIG. 11 and includes an independently adjustable air duct 58*d* and trajectory plate 56*d*. The air duct 58*d* rotates about a pivot 91 and is held in position by an adjustable retainer 86*d* capable of moving along an adjusting slot 96*d*. Similarly, trajectory plate 56*d* is pivotally attached to the air-swept distributor 30*d* by way of a pivot 93 and is retained by similar adjustable retainers 86*d* and adjusting slots 96*d*.

FIGS. 12 through 16 are exemplary graphs 100*a* through 100*e*, showing the static air pressure in inches of $H_2O$ along the vertical axis and showing time in a "minutes:seconds" format along the horizontal axis. Generally, static air pressure is varied between a minimum and a maximum in order to more evenly distribute fuel along the grate 18 in the furnace 10. Maximum air pressure distributes the fuel to the furthermost grate area 18*a* and minimum air pressure distributes fuel a minimum distance from the distributor to the nearest grate area 18*d*.

Figure 12:
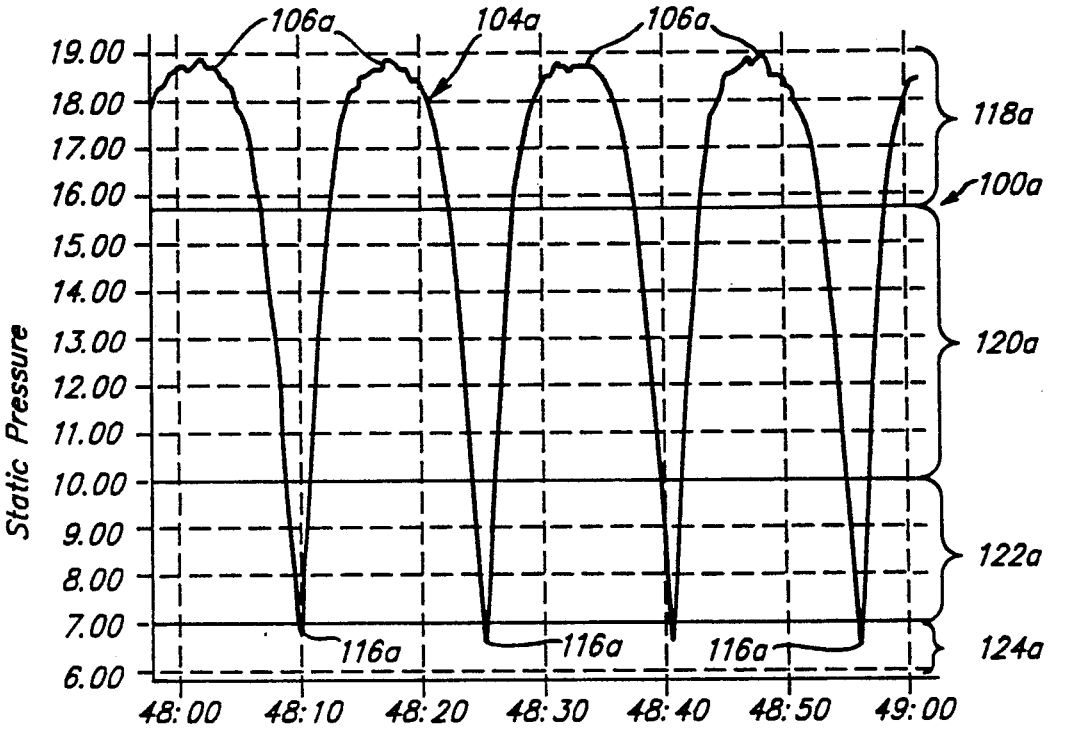
FIG. 12 is a plot of static air pressure against time in a distribution system having a standard rotating damper in accordance with the prior art.

Conventional, prior art systems produce a static air pressure-versus-time graph 100*a*, as shown in FIG. 12, wherein the curve 104*a* has a series of maximums 106*a* and a series of minimums 116*a*. The period time between a pair of maximums or a pair of minimums is the period of rotation, and for the curve 104*a*, a period is approximately 15 seconds. The curve 104*a* can be broken into four areas under the curve in respective regions 118*a*, 120*a*, 122*a*, and 124*a*, which are directly proportional to the amount of fuel blown into the four corresponding areas of a grate 18*a*, 18*b*, 18*c*, and 18*d*. Thus, the amount of fuel distributed to 18*a* is proportional to the area in the region 118*a*, defining the highest static air pressure. Similarly the fuel distributed to grate area 18*b* corresponds to the area in the region 120*a*, the fuel distributed to grate area 18*c* corresponds to the area in the region 122*a*, and the fuel distributed to grate area 18*d* corresponds to the area in the region 124*a*.

As is evident from the small area in the region 124*a*, the conventional prior art rotating damper provides very little fuel to grate area 18*d*. On the other hand, a significant portion of the fuel will be distributed to grate area 18*a* as evident from the area in the region 118*a*. Thus as can be readily seen, curve 104*a* for the conventional rotating damper provides neither an even fuel distribution nor a fully controllable air pressure curve.

Figure 13:
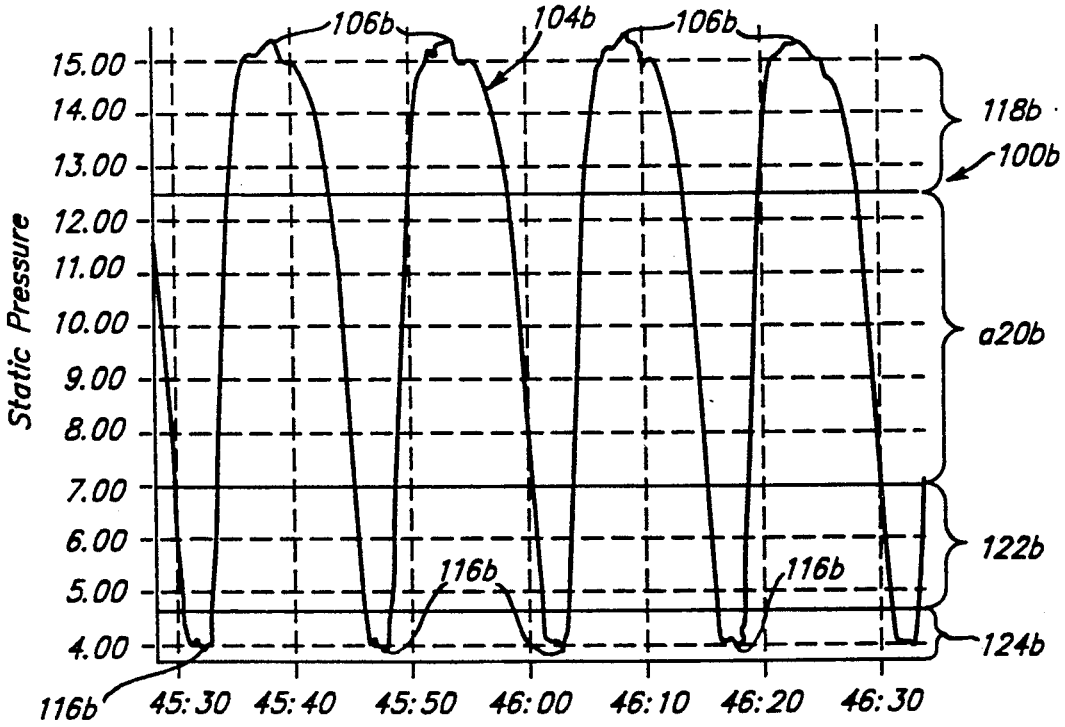
FIG. 13 is a plot similar to that of FIG. 12, but illustrating the static air pressure against time in a distribution system using an oscillating controller having a two second dwell time.

Curves 104*b* through 104*e* showing the static air pressure produced by an oscillating damper in accordance with the present invention, are shown in FIGS. 13 through 16. Graph 100*b*, as shown in FIG. 13, has a curve 104*b*, having an area in the region 118*b*, an area in the region 120*b*, an area in the region 122*b*, and an area in the region 124*b*. The curve 104*b* was produced by damper oscillation between a first position at 7° and a second position at 75°, and had a two-second dwell time at the first position. As compared to the graph 100*a* produced by a prior art rotating damper, the graph 100*b* has a curve 104*b* that has a larger area in the region 124*b* and a smaller area in the region 118*b*. The larger area in the region 124*b* is crucial to distributing fuel to grate area 18*d*. Therefore, an oscillating damper producing the curve 104*b* will distribute fuel more evenly than the conventional rotating damper. An oscillating damper producing the curve 104*b* has been found useful for the distribution of fuel composed wood chips having a high water content.

Figure 14:
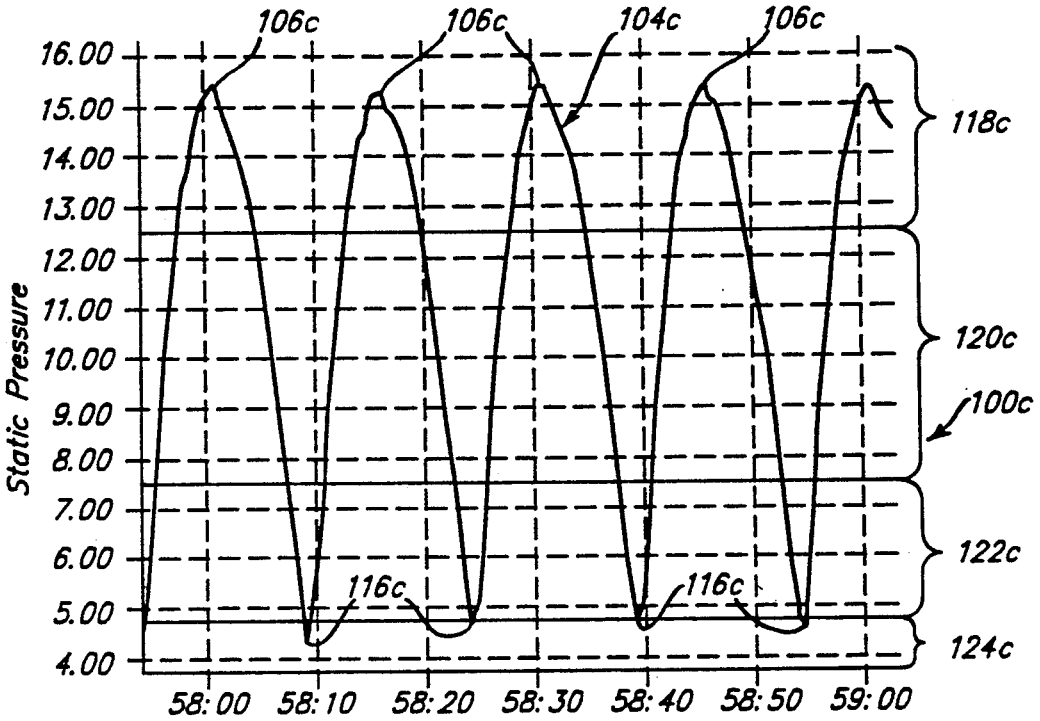
FIG. 14 is a plot similar to that of FIGS. 12 and 13, but illustrating the static pressure against time in a distribution system using an oscillating controller having no dwell time, but oscillating between a smaller range of angles.
Figure 15:
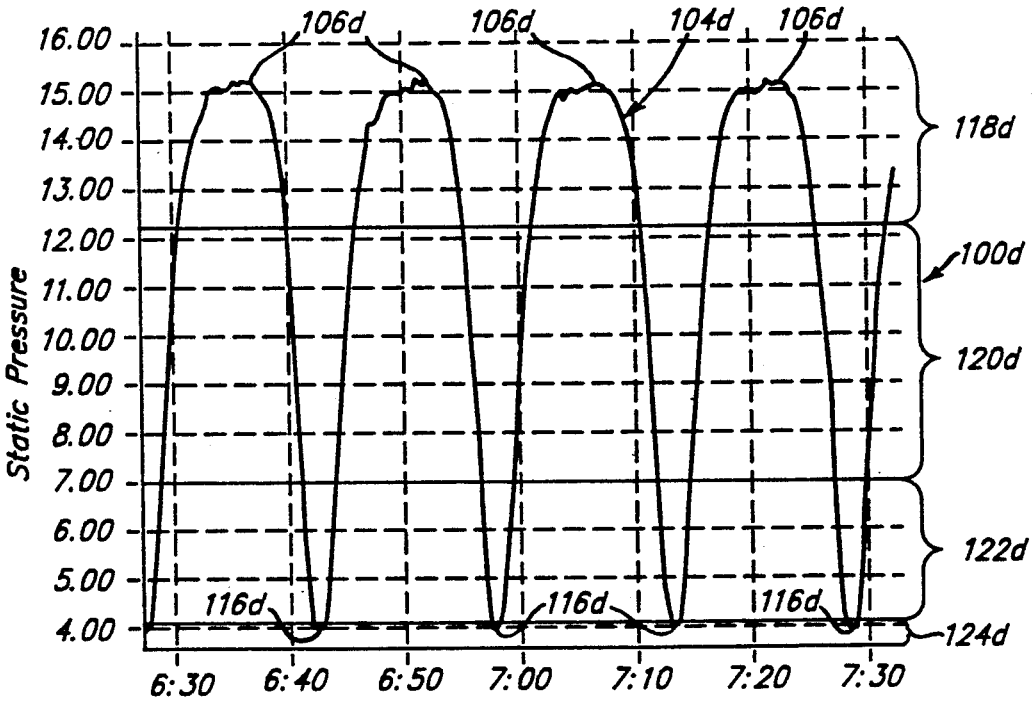
FIG. 15 is yet another plot of the static air pressure against time in a distribution system having an oscillating damper with a one-second dwell time and a modified oscillation period in accordance with the present invention.
Figure 16:
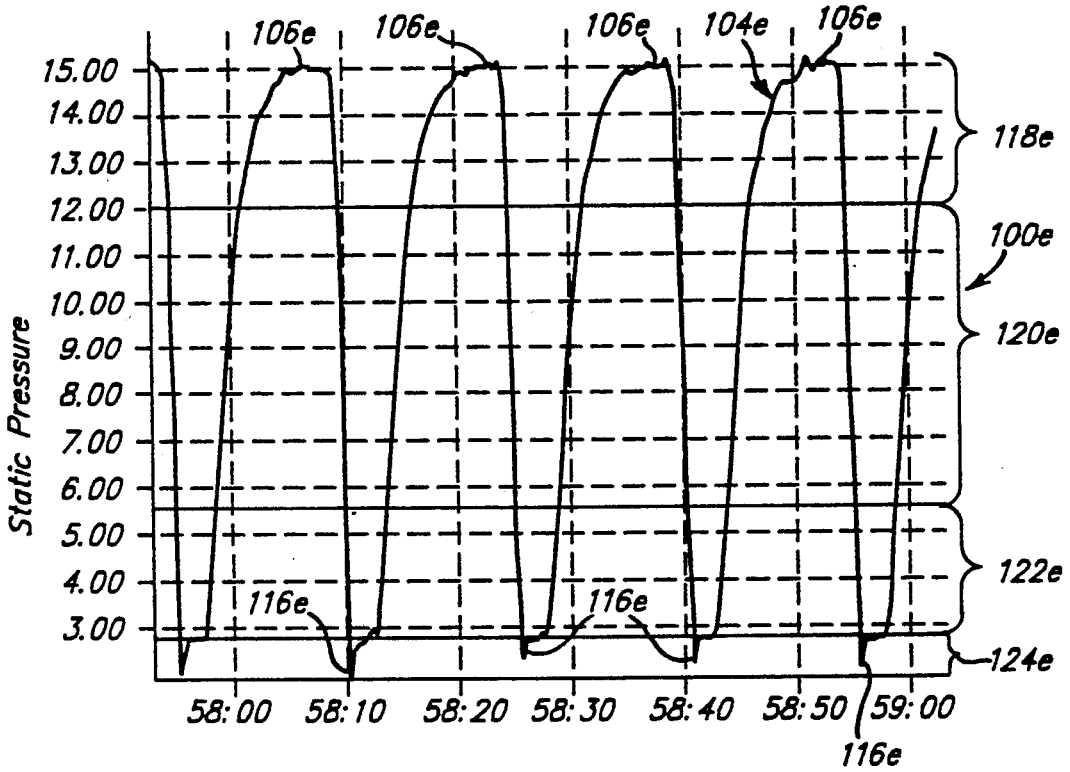
FIG. 16 is a plot similar to that of FIG. 15, but illustrating the static air pressure against time in a distribution system having an oscillating damper with a two-second dwell time and a modified oscillation period in accordance with the present invention.

FIGS. 14 through 16 (graphs 100*c* through 100*e*) have curves 104*c* through 104*e*, respectively, and represent other variations of static air pressures producible with an oscillating damper in accordance with the present invention. Graph 100*c* shows a curve 104*c* produced from an oscillating damper between a first position at 7° and a second position at 60° and having no dwell. An oscillating damper having this setting produces relatively small areas in the regions 118*c* and 124*c* and relatively larger areas in the regions 120*c* and 122*c*. This setting would be useful for fuel composed of wood chips having a medium water content.

Graph 100*d* of FIG. 15 shows a curve 104*d* produced from an oscillator having a one second dwell and a modified period such that the movement from a second position at 75° to a first position at 7° is four seconds and the movement from the first position 7° to the second position at 75° is ten seconds. The area in the region 118*d* is larger, and therefore more fuel is distributed to the back grate area 18*a*, the area in the region 124*d* is mid-sized, and some fuel is distributed to the front grate area 18*d*. The middle areas in the regions 120*d* and 122*d* have sides of variable slope, which enable the distribution system to distribute more or less fuel to the middle parts of the grate, with more fuel being distributed to the middle grate parts when the curves through the regions 120*d* and 122*d* are less steeply sloped and less fuel being distributed to the middle grate sections when the curve is steeper through the regions 120*d* and 122*d*.

Graph 100*e* of FIG. 16 shows the curve 104*e* produced from an oscillating damper having a two-second period between the second position at 75° to the first position at 7°, an eleven-second period from the first position at 7° to the second position at 75°, and a two-second dwell time at the first position. The sharply steeped portion of this curve, corresponding to the two-second period for oscillating the value from 7° to 75°, will effectively cause fuel to miss the middle portions of the grate, 18*b* and 18*c*. Such an extreme setting would be useful when fuel should be distributed to the front and back of the grate only or when the orientation of trajectory plates requires this type of setting.

While it would be apparent that the preferred embodiments of the invention disclosed are well calculated to provide the advantages and features above stated, it will be appreciated that the invention is susceptible to modification, variation and change without departing from the proper scope and fair meaning of the following claims.

What is claimed is:

1. A fuel distribution system for distributing fuel into a furnace, comprising:

a) at least one oscillating damper, said oscillating damper having an air supply duct, a pivotal valve member mounted in said air supply duct for oscillation about an axis, and control means attached to said valve member for controlling the oscillation of said valve member, thereby controllably adjusting the flow of air through said air supply duct and to effect an adjustable throttling of the air flow therethrough;

b) at least one air-swept distributor, said air-swept distributor having a fuel inlet duct and a pivotable air chamber, a trajectory plate attached to said air chamber for pivotal movement therewith with respect to said fuel inlet duct for controlling the distribution of fuel into the furnace, means for directing air across said trajectory plate to controllably blow the fuel across the plate and thereby further provide a controllable distribution of fuel into the furnace, said pivotable air chamber having an air inlet opening and at least one air outlet opening for directing air across said trajectory plate;

c) means for communicating air from said oscillating damper to said air-swept distributor; and d) adjustment means actuable to pivot said air chamber and said trajectory plate in order to change the pivoted orientation thereof and thereby adjustably vary the distribution of fuel into the furnace, said adjustment means being actuable in conjunction with said oscillation of said oscillating damper by said control means.

2. The fuel distribution system of claim 1, wherein said fuel inlet duct has a slanted sliding surface for causing fuel to advance toward the furnace.

3. The fuel distribution system of claim 2, wherein said trajectory plate is spaced from the bottom of said slanted sliding surface.

4. The fuel distribution system of claim 2, wherein said trajectory plate and said slanted sliding surface each include a cladded wear plate thereon.

5. The fuel distribution system of claim 1, further comprising a balanced damper disposed over said fuel inlet duct for preventing back drafts of hot gases emanating from the furnace.

6. The fuel distribution system of claim 1, wherein said air inlet chamber includes an orifice plate having a plurality of holes for directing fluid evenly across said trajectory plate.

7. The fuel distribution system of claim 1, wherein said air inlet opening in said air chamber is rotationally enlarged to provide entering air communication between said oscillating damper and said air-swept distributor regardless of said pivoted orientation of said trajectory plate.

8. The fuel distribution system of claim 7, wherein said air-swept distributor includes sealing means engaging said pivotal chamber in order to prevent air leakage thereby.

* * * * *